US008113766B2

(12) United States Patent
Chang et al.

(10) Patent No.: US 8,113,766 B2
(45) Date of Patent: Feb. 14, 2012

(54) FAN AND FAN FRAME THEREOF

(75) Inventors: Shun-Chen Chang, Taoyuan Hsien (TW); Chia-Ming Hsu, Taoyuan Hsien (TW); Wen-Bin Liu, Taoyuan Hsien (TW); Shir-Harn Yeh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1043 days.

(21) Appl. No.: 12/068,519

(22) Filed: Feb. 7, 2008

(65) Prior Publication Data

US 2008/0247864 A1 Oct. 9, 2008

(30) Foreign Application Priority Data

Apr. 4, 2007 (TW) ..... 96112019 A

(51) Int. Cl.
*F04D 29/66* (2006.01)
*F04D 29/52* (2006.01)

(52) U.S. Cl. ..... 415/119; 415/220

(58) Field of Classification Search ..... 415/119, 415/213.4, 214.1, 220, 213.1; 417/423.14
See application file for complete search history.

(56) References Cited

U.S. PATENT DOCUMENTS 2,028,985 A * 1/1936 Mahon ..... 415/119
3,947,148 A * 3/1976 Holt ..... 415/119
6,896,095 B2 * 5/2005 Shah et al. ..... 181/198

* cited by examiner

*Primary Examiner* — Edward Look
*Assistant Examiner* — Liam McDowell
(74) *Attorney, Agent, or Firm* — Birch, Stewart, Kolasch & Birch, LLP

(57) ABSTRACT

A fan includes an impeller and a fan frame. The fan frame has a main body and at least one sound absorber, wherein the main body has a passage for receiving the impeller, a plurality of flanges are disposed on a periphery of the main body, a recess is defined between the two adjacent flanges, an aperture is disposed on a wall of the main body corresponding to the recess so as to allow the recess to communicate with the passage, and the sound absorber is disposed in the recess. Also, a cover is assembled in the main body and covers the sound absorber within the recess.

14 Claims, 8 Drawing Sheets

FAN AND FAN FRAME THEREOF

BACKGROUND OF THE INVENTION

1. Field of the Invention

The present invention relates to a fan and a fan frame thereof, and in particular to a noiseless fan with disposition of sound absorbers requiring limited space, successfully reducing noises during operation.

2. Description of the Related Art

Within the field of heat dissipation of electronic devices, fans are commonly used in computer systems and many electronic products mainly because fans are cheap, reliable and efficient. In early years, fans were valued based upon heat dissipating efficiency, but noise produced by the fans were ignored. However, in an electronic device, most noise is originated from fans. As shown in FIG. 1, a standard fan 1 has a frame 101 covering an impeller 102, and impeller 102 rotates to produce air flows for heat dissipation. However, the wall of the frame 101 is made of rigid materials. When the impeller 102 rotates, the pressure at the wall changes periodically, and then produces steady sounds (or call noises). Further, the higher the frame 101, the louder the noises produced by the fan because the sound wave reflects, diffracts and resonates between the walls of the frame 101.

An improved conventional fan is disclosed in FIG. 2. A conventional computer fan is disposed within the chamber 13 of the housing 10, and a sound-absorbing cotton 23 is disposed in the housing 10 for surrounding the fan. The periphery of the frame 20 of the fan has several holes 24, so that noise produced during operation of the impeller 40 can be absorbed by the sound-absorbing cotton 23 in the chamber 13.

Nevertheless, fans used in electronic production have standard sizes. For example, a fan labeled 80*30 means the length and width are both 80 mm, and the height is 38 mm. If the above method is applied to a standard-sized fan to reduce noises, the size of the fan and the manufacturing cost would increase accordingly. The increase of size makes the fan to be a non-standard sized fan. For users, fans with non-standardized sizes may cause problems when fitted to modulated heat dissipating systems. In other words, the fans applications are limited when applying to standardized computer and electronic systems.

BRIEF SUMMARY OF THE INVENTION

The present invention provides a fan and fan frame thereof. At least one sound absorber is disposed using a limited space in a fan without increasing fan volume, such that the sound is absorbed during the operation, thereby decreasing or even eliminating noises produced by the fan.

Accordingly, the present invention provides a fan including an impeller and a fan frame. The fan frame has a main body having a passage for receiving the impeller. A plurality of flanges are disposed on the periphery of the main body. A recess is defined between the two adjacent flanges. An aperture is disposed on a wall of the main body corresponding to the recess so as to allow the recess to communicate with the passage. The fan frame further has at least one sound absorber, the shape of the sound absorber corresponds to the shape of the recess, and the size of the sound absorber is slightly less than the size of the recess, such that the sound absorber can be disposed in the recess. The sound absorber is made of a porous material, and a plurality of holes with different diameters is formed on the porous material.

The fan frame further includes a cover, wherein the shape of the cover corresponds to the shape of the recess, and the size of the cover is less than the size of the recess, such that the cover can be disposed in the recess and covers the sound absorber. A gap is formed between the cover and the sound absorber. Additionally, when the cover covers the recess, an exterior surface of the cover is flush with the lateral surface of the main body, and does not protrude from the main body.

A first through hole is formed on each of the flanges, and a second through hole is correspondingly formed on the sound absorber so as to allow an additional fixing member to pass through and then to secure the fan in a computer or an external system. Furthermore, a supporting member is disposed in the aperture for securing the sound absorber within the recess and ensuring a regular operation of the impeller.

The present invention provides a fan frame including a main body and at least one sound absorber. The main body has a passage, and a plurality of flanges are disposed on the periphery of the main body. A recess is defined between the two adjacent flanges. An aperture is disposed on a wall of the main body corresponding to the recess so as to allow the recess to communicate with the passage. The shape of the sound absorber corresponds to the shape of the recess, and the size of the sound absorber is slightly less than the size of the recess, such that the sound absorber can be disposed in the recess. The sound absorber is made of a porous material, and a plurality of holes with different diameters is formed on the porous material.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 3:
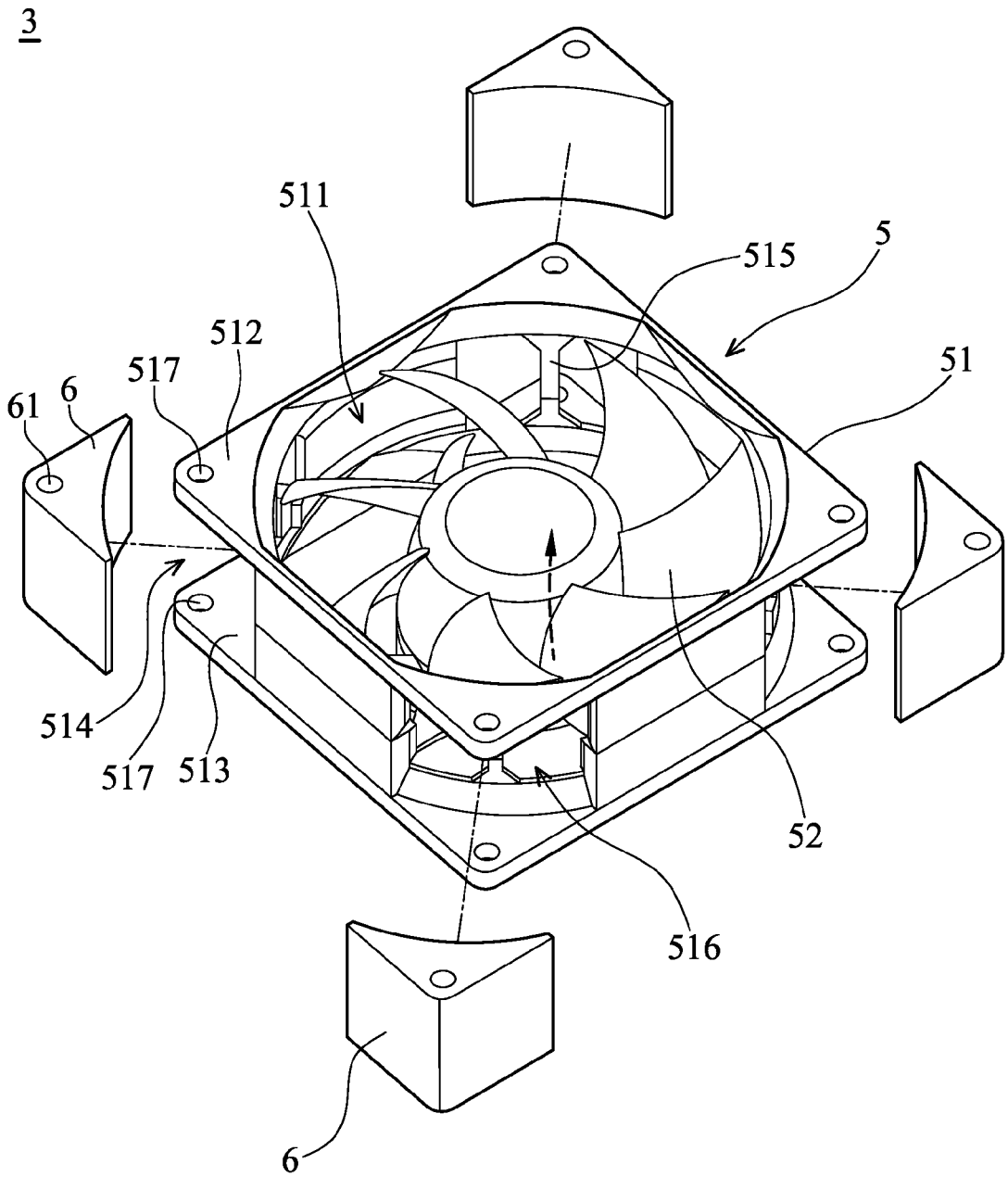
FIG. 3 is an exploded view of a fan having a sound absorber according to the preferred embodiment of the present invention.
Figure 4:
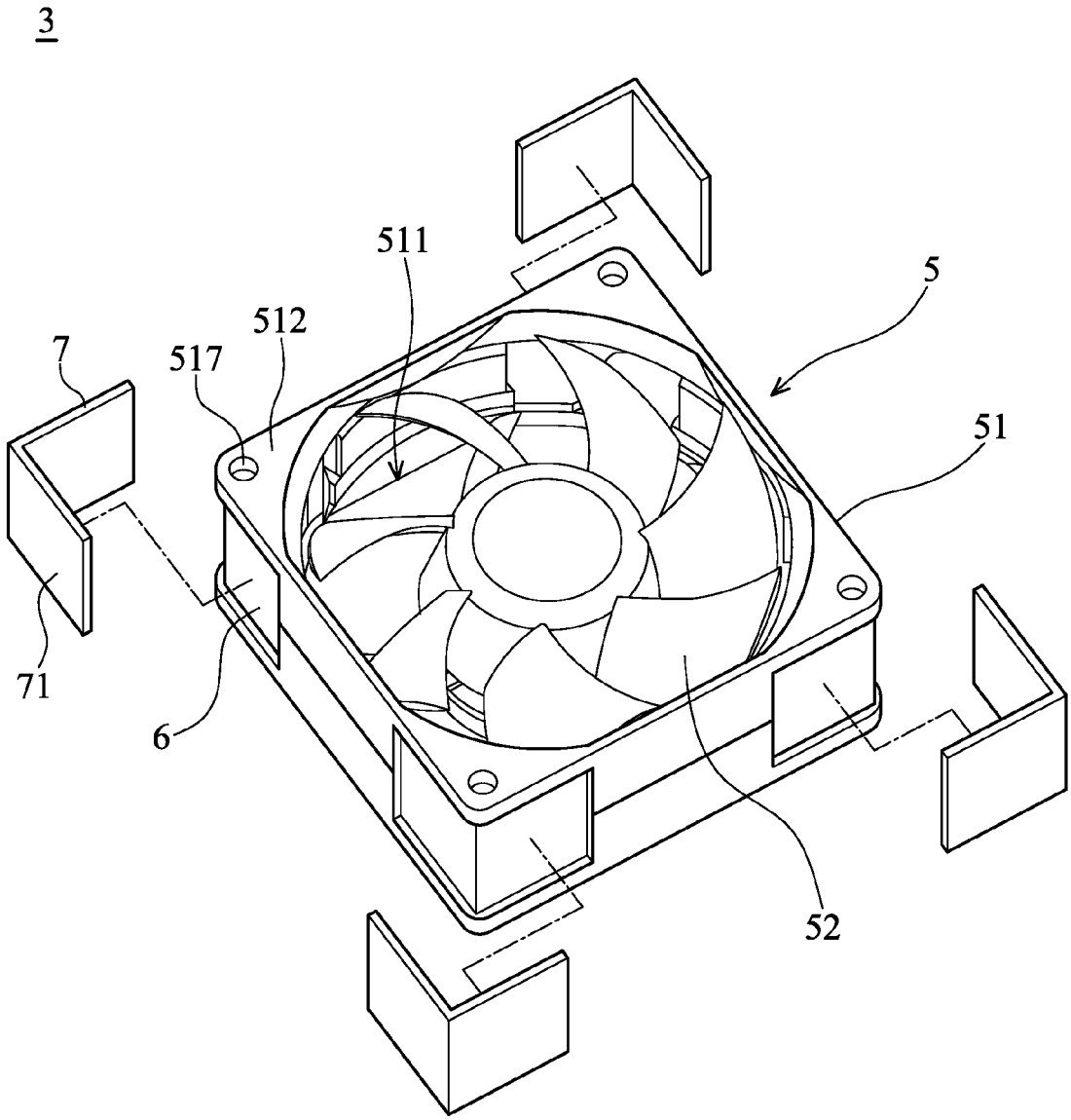
FIG. 4 is an exploded view of the fan shown in FIG. 3 with a cover.

FIG. 3 is an exploded view of a fan with a sound absorber according to the preferred embodiment of the present invention, and FIG. 4 is an exploded view of the fan shown in FIG. 3 with a cover. Referring to FIGS. 3 and 4, the fan 3 can be used in a computer as a heat dissipating fan, but the example is not limited thereto. In other embodiments, the fan 3 can be applied to servers or telecommunication products. The fan 3 includes a fan frame 5 and an impeller 52 disposed within the fan frame 5. The fan frame 5 has a rectangular main body 51, at least one sound absorber 6 and at least one cover 7 disposed close to the main body 51. In FIGS. 3 and 4, there are four sound absorbers 6 and four covers 7 corresponding to these sound absorbers 6. The main body 51 has a passage 511 formed in the main body 51 for receiving the impeller 52 and the motor (not shown). There are two flanges 512, 513, which are relative to the inlet and the outlet of the fan frame 5 respectively, formed on each of the corners of the main body 51, and a recess 514 is defined between the adjacent flanges 512, 513.

An aperture 516 is formed on a wall of the main body 51 neighboring to the recess 514, allowing the recess 514 to communicate with the passage 511 of the main body 51. A supporting member 515 is disposed in the aperture 516. Further, there is one first through hole 517 formed on each of the flanges 512, 513, respectively, to allow an additional fixing member, a screw for example (not shown), to pass through, in order to secure the fan 3 in a computer or a external system (not shown). It is noted that the number and the size of the aperture 516 on the wall of the main body 51 is varied according to tactual noise frequency produced by the impeller 52, and together with the disposition of the sound absorber 6, the appropriate number and the size of the aperture 516 is then decided to obtain the best absorption result. The number of the aperture 516 is one, but it is not limited thereto.

The shape of the sound absorber 6 corresponds to the shape of the recess 514 of the main body 51, which implies that the shape of the sound absorber 6 is varied with the shape of the recess 514. The size of the sound absorber 6 is slightly less than the size of the recess 514, such that the sound absorber 6 is able to be received in the recess 514. The supporting member 515 secures the sound absorber 6 within the recess 514 and ensures the regular operation of the impeller 52 due to the interruption caused by sliding of the sound absorber 6. The sound absorber 6 is made of a porous material, and a plurality of holes (not shown) with different diameters are formed on the porous material. Moreover, in consideration of a screw (not shown) passing through the through holes 517 for securing the fan 3 in a computer or a external system, a second through hole 61 is formed in the sound absorber 6 for matching the relative through holes 517 when the sound absorber 6 is disposed in the recess 514 and between two flanges 512 and 513.

Figure 5:
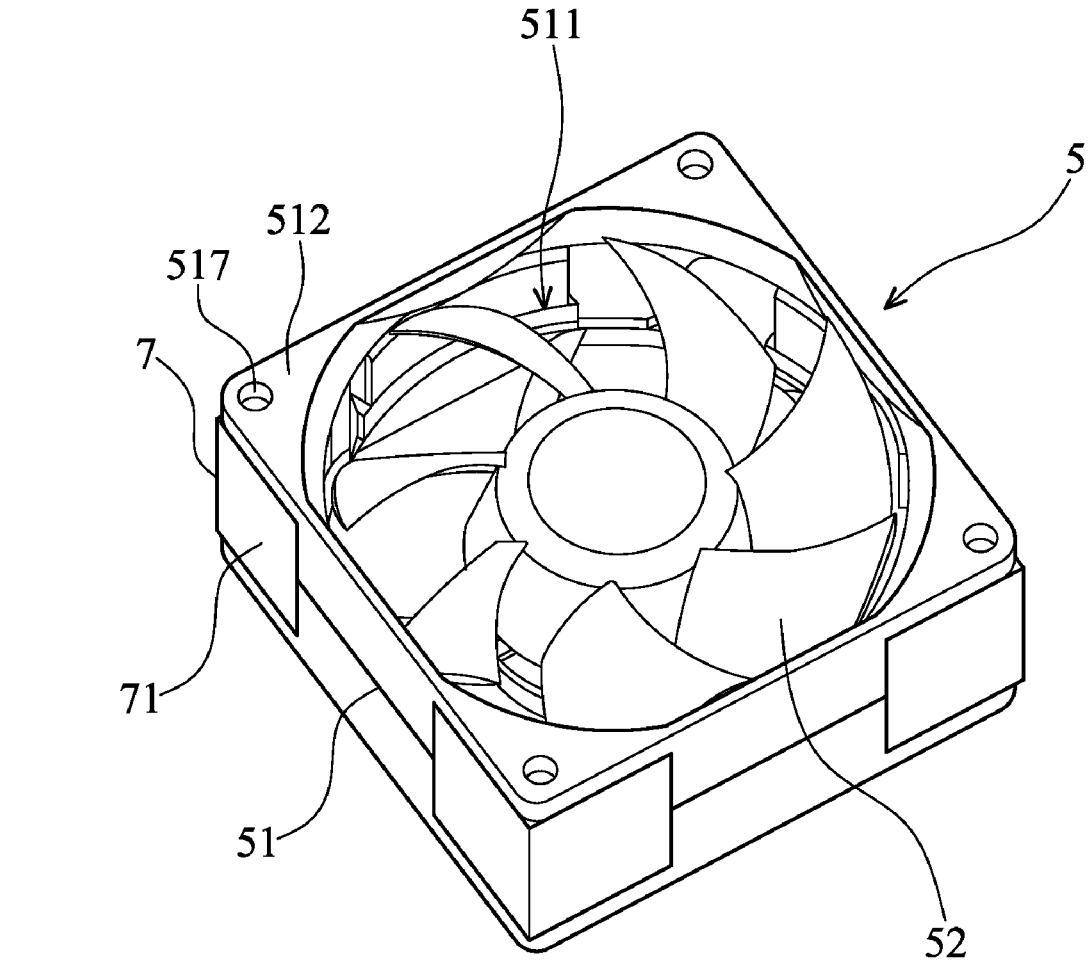
FIG. 5 is a schematic view of the fan with the cover in FIG. 4.

The cover 7 is assembled to the corresponding recess 514 and is fixed on the main body 51 of the fan frame 5. The shape of the cover 7 corresponds to the shape of the recess 514. In the embodiment, the shape of the cover 7 is in L shape, but it is not limited thereto. The shape of the cover varies with the shape of the recess 514. As shown in FIG. 5, when the cover 7 covers the recess 514, the exterior surface 71 is flush with the lateral surface of the main body 51 and does not protrude from the main body 51, thereby improving the overall appearance of the fan 3.

The noiseless fan of the present invention includes the sound absorber 6 in the recess 514 of the main body 51 to absorb noises without increasing original volume. The technique of the present invention is further described as below. The cover 7 covers the recess 514 to conceal the sound absorber 6 in the recess 514. In addition, the aperture 514 is on the wall 515 of the main body 51 so as to allow the recess 513 to communicate with the passage 511 of the main body 51. Thereby, the sound absorber 6 successfully absorbs noises produced by the rigid material of the main body 51. When the sound wave produced during the rotation of the impeller 52 passes the surface of the sound absorber 6 with holes, sound energy is transferred into thermal energy by friction effect, thereby reducing noises of the fan.

Figure 6:
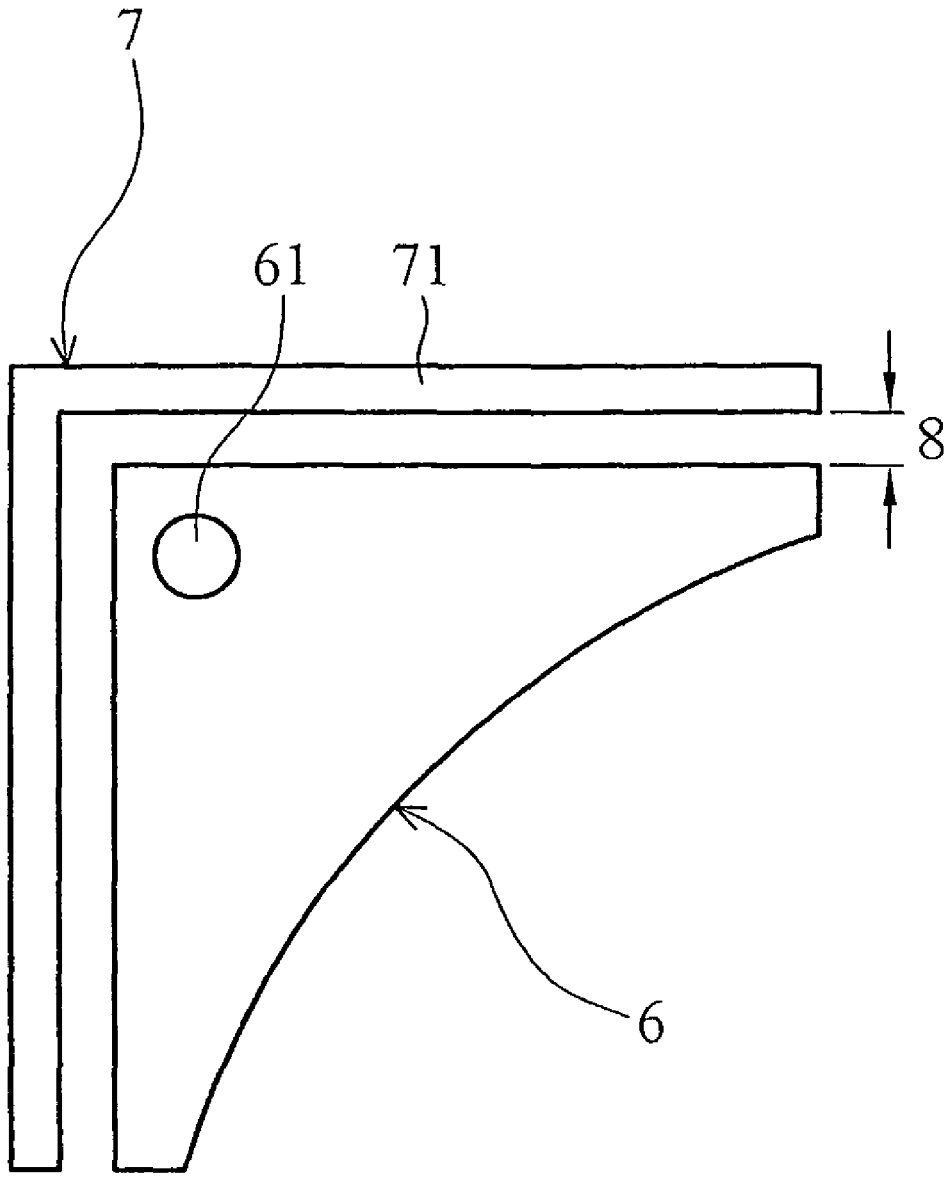
FIG. 6 is a schematic view showing the relative position of the sound absorber and the cover of the fan in FIG. 5.

As shown in FIG. 6, a gap 8 is formed between the sound absorber 6 in the recess 514 of the main body 51 and the cover 7. The gap 8 changes the acoustic resistance of the sound absorber 6 so as to allow the sound absorber 6 to absorb noises with different sound waves. As a result, the method can be used to eliminate noise with particular frequencies. On the other hand, the gap 8 is not sufficient between the sound absorber 6 and the cover 7 to sustain efficient absorption. In the present invention, the gap 8 is kept between the sound absorber 6 and the cover 7, but it is not limited thereto.

Figure 1:
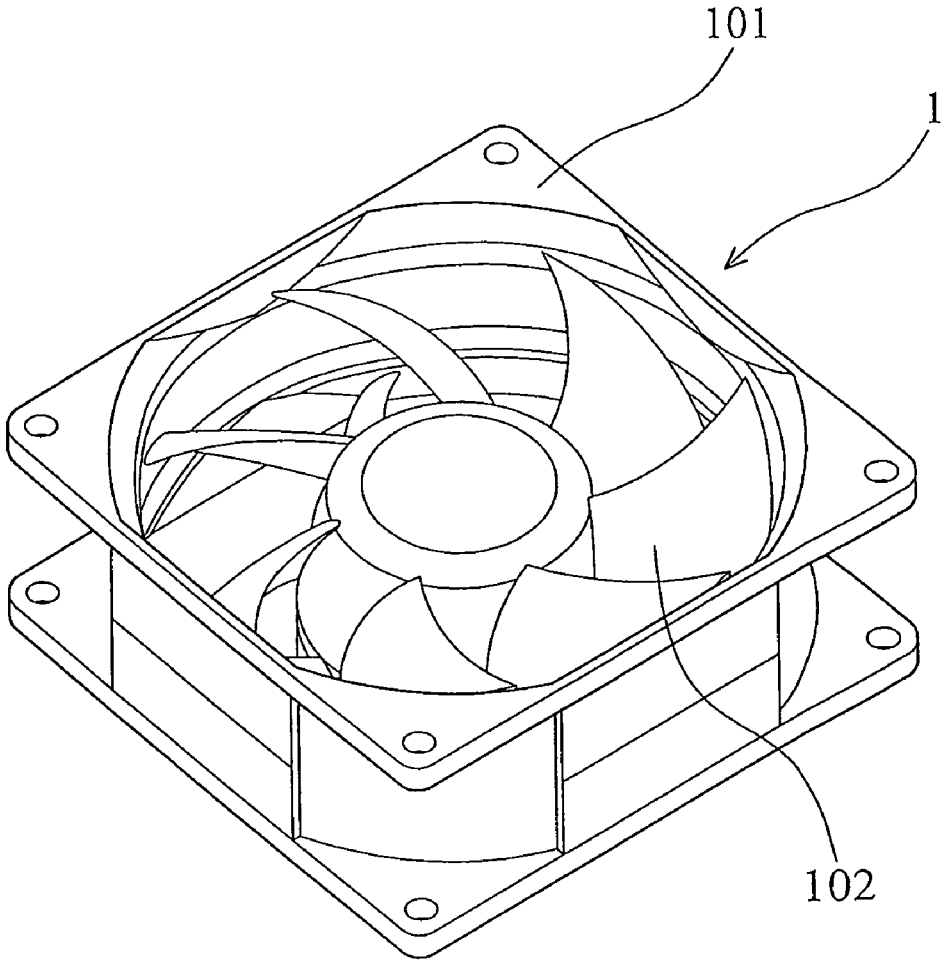
FIG. 1 ( PRIOR ART )
FIG. 1 is a schematic view of a conventional fan.
Figure 2:
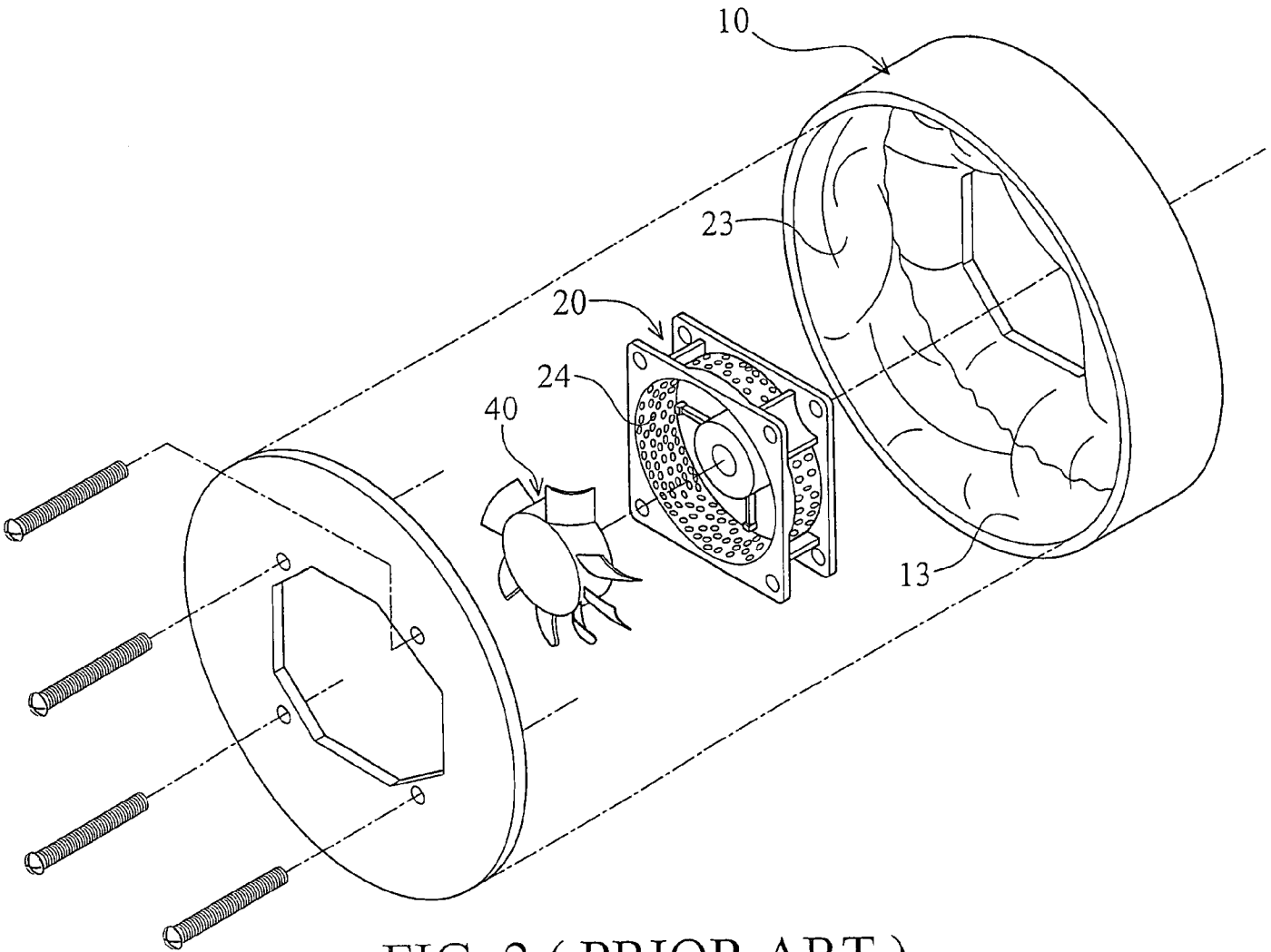
FIG. 2 ( PRIOR ART )
FIG. 2 is an exploded view shows a conventional fan disposed in a conventional housing with a sound-absorbing cotton.
Figure 7:
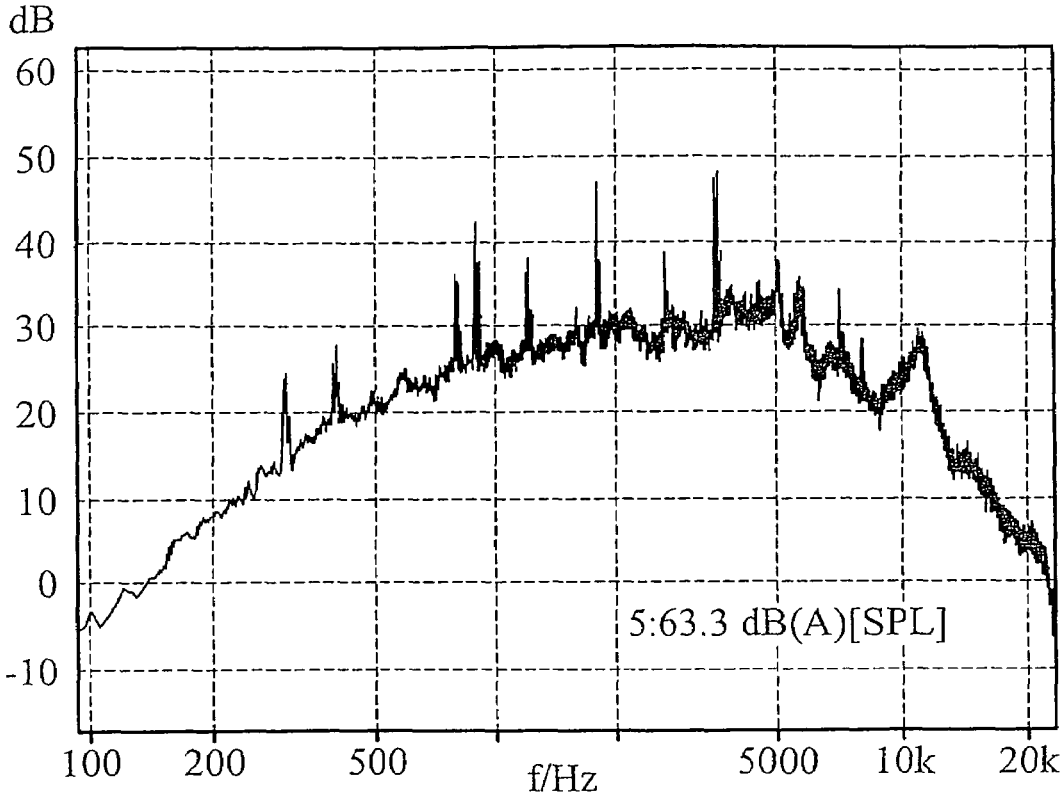
FIG. 7 is a curvature diagram showing the noise characteristics of the conventional fan.
Figure 8:
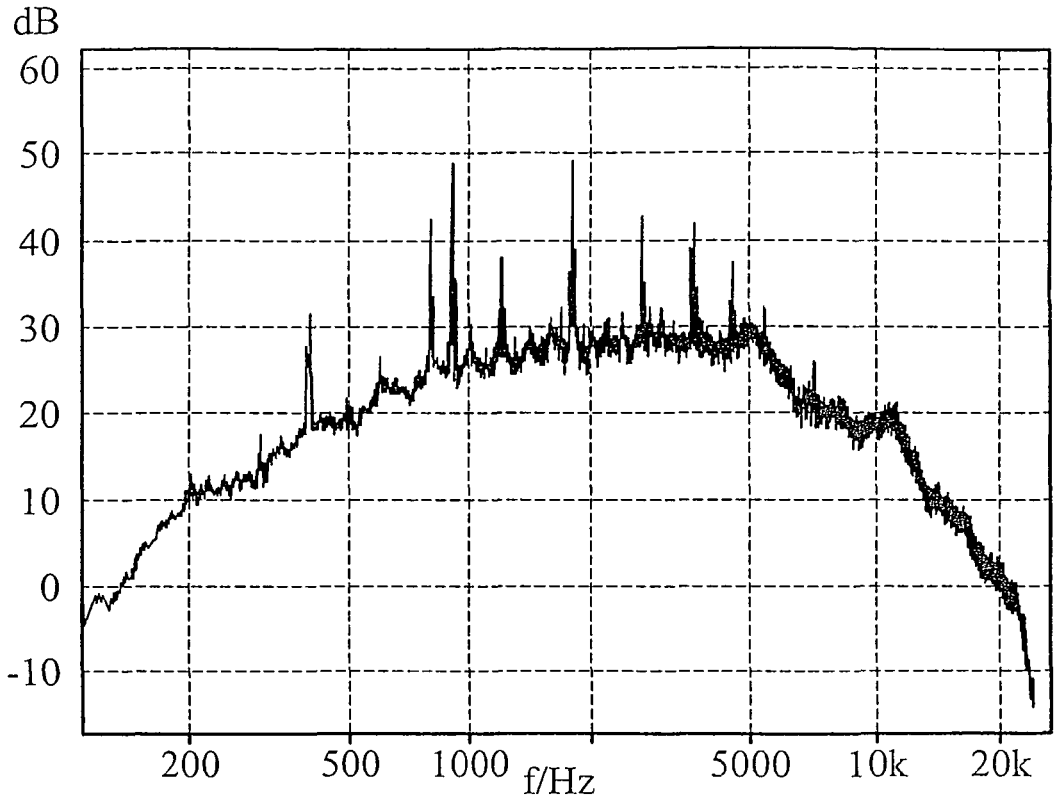
FIG. 8 is a curvature diagram showing the noise characteristics of the fan of the present invention.

Referring to FIGS. 7 and 8, curvature diagrams show measurement of the conventional standard 9 cm fan in FIG. 1 and the noiseless 9 cm fan of the present invention by a precise instrument. The longitudinal axis represents noise level and the lateral axis t represents frequency. In the diagram, the noise level of 61.6 dB(A) is measured from the noiseless fan of the present invention, and the noise level of 63.6 dB(A) is measured from the conventional fan. As a result, compared to the conventional fan, the fan of the present invention successfully reduces noise level by 2 dB(A).

As described, the present invention discloses a noiseless fan. At least one sound absorber is disposed using a limited space in a fan, thereby absorbing noises during the operation of the impeller of the fan and decreasing the noise level produced by the fan. In other words, the volume and height of the fan are not increased in order to keep its original appearance, saving costs, conforming to standard sizes and raising noise comfort.

While the present invention has been described by way of example and in terms of preferred embodiment, it is to be understood that the present invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising:

an impeller; and a frame comprises a main body and at least one sound absorber, wherein the main body has a passage for receiving the impeller, a plurality of flanges are disposed on a periphery of the main body, a recess is defined between two adjacent flanges, an aperture is disposed on a wall of the main body corresponding to the recess so as to allow the recess to communicate with the passage, and the at least one sound absorber is disposed in the recess, wherein the frame further comprises at least one cover assembled in the main body and covering the at least one sound absorber within the recess, a shape of the at least one cover corresponds to a shape of the recess, and a size of the at least one cover is less than a size of the recess.

2. The fan as claimed in claim 1, wherein the sound absorber has a shape corresponding to a shape of the recess, and a size of the at least one sound absorber is less than a size of the recess.

3. The fan as claimed in claim 1, wherein the at least one sound absorber comprises a porous material.

4. The fan as claimed in claim 1, wherein when the at least one cover covers the recess, an exterior surface of the cover is level with the frame, and the exterior surface of the cover does not protrude from the main body.

5. The fan as claimed in claim 1, wherein a gap is formed between the at least one cover and the at least one sound absorber.

6. The fan as claimed in claim 1, wherein a first through hole is formed on each of the flanges, and a second through hole is correspondingly formed on the at least one sound absorber so as to allow a fixing member to pass through and then to secure the fan in a computer or an external system.

7. The fan as claimed in claim 1, wherein a supporting member is disposed in the aperture for securing the at least one sound absorber within the recess and ensuring a regular operation of the impeller.

8. A fan frame, comprising:

a main body frame having a passage, wherein a plurality of flanges are disposed on a periphery of the main body, a recess is defined between two adjacent flanges, and an aperture is disposed on a wall of the main body corresponding to the recess so as to allow the recess to communicate with the passage;

at least one sound absorber disposed in the recess; and at least one cover assembled in the main body and covering the at least one sound absorber within the recess, wherein a shape of the at least one cover corresponds to a shape of the recess, and a size of the at least one cover is less than a size of the recess.

9. The fan frame as claimed in claim 8, wherein the at least one sound absorber has a shape corresponding to a shape of the recess, and a size of the at least one sound absorber is less than a size of the recess.

10. The fan frame as claimed in claim 8, wherein the at least one sound absorber comprises a porous material.

11. The fan frame as claimed in claim 8, wherein when the at least one cover covers the recess, an exterior surface of the at least one cover is level with the fan frame, and the exterior surface of the at least one cover does not protrude from the main body.

12. The fan frame as claimed in claim 8, wherein a gap is formed between the at least one cover and the at least one sound absorber.

13. The fan frame as claimed in claim 8, wherein a first through hole is formed on each of the flanges, and a second through hole is correspondingly formed on the at least one sound absorber.

14. The fan frame as claimed in claim 8, wherein a supporting member is disposed in the aperture for securing the sound absorber within the recess.

* * * * *